United States Patent [19]

Petroff

[11] Patent Number: 5,009,040

[45] Date of Patent: Apr. 23, 1991

[54] BLADE SHARPENER

[75] Inventor: Cvetan Petroff, Kew, Australia

[73] Assignee: McPherson's Limited, Australia

[21] Appl. No.: 569,084

[22] Filed: Aug. 17, 1990

[30] Foreign Application Priority Data

Aug. 28, 1989 [AU] Australia ..... PJ6017
Feb. 1, 1990 [AU] Australia ..... PJ8419

[51] Int. Cl.[5] ..... B24B 33/00

[52] U.S. Cl. ..... 51/214; 51/221 BS; 30/138; 76/86

[58] Field of Search ..... 51/221 BS, 158, 170 R, 51/149, 214; 30/138; 76/82, 86, 88; 83/174

[56] References Cited

U.S. PATENT DOCUMENTS 4,494,339 1/1985 Pittaway ..... 76/82
4,669,337 6/1987 Petroff ..... 51/214
4,869,027 9/1989 McEvily ..... 51/214

*Primary Examiner*—Frederick R. Schmidt
*Assistant Examiner*—John R. Schwarzmann
*Attorney, Agent, or Firm*—Lerner, David, Littenberg, Krumholz & Mentlik

[57] ABSTRACT

A blade sharpener having a sharpening mechanism which functions to sharpen a blade engaging that mechanism and being moved longitudinally relative thereto. The sharpener also includes sharpening defeating means which, when operative, at least inhibits and possibly prevents sharpening of a blade by the sharpening mechanism when that blade is moved longitudinally through the sharpener in one direction. The defeating means is responsive to blade movement so as to adopt an operative condition when the blade is moved in the aforementioned one direction, and to adopt an inoperative condition when the blade is moved through the sharpener in the opposite direction. The defeating means includes a blade engaging member such as a roller, and in the operative condition that roller engages and presses against the cutting edge of the blade so as to impose a force on the blade which acts counter to the force causing the blade to engage the sharpening mechanism. The counter force therefore tends to push the blade out of contact with the sharpening mechanism. The roller does not engage the blade, or at least does not apply the counter force, when the defeating means is in the inoperative condition. An anti-bottoming groove is provided around the circumferential surface of the roller to provide a location for the cutting edge of the knife blade and that groove is formed to avoid contact between the actual cutting edge of the blade and the base of the groove.

18 Claims, 3 Drawing Sheets

BLADE SHARPENER

FIELD OF THE INVENTION

This invention relates to blade sharpeners, and is particularly but not exclusively concerned with knife and scissor sharpeners. It will be convenient to hereinafter describe the invention with particular reference to knife sharpeners of the kind incorporated in blade scabbards, but the invention has other applications.

PRIOR ART

Examples of combined scabbard-sharpeners are disclosed by U.S. Pat. Nos. 3,676,961, 3,774,350, 4,041,651, 4,091,691, and 4,805,350. A feature common to the sharpeners of those U.S. patents is that the blade is sharpened during movement into the scabbard as well as during movement out of the scabbard. Some users find such two way sharpening uncomfortable because of the force necessary to push the blade inwards through the sharpening mechanism, whereas a similar difficulty is not experienced in pulling the blade through the sharpening mechanism during outward movement of the blade.

The action of pushing a blade through a sharpener is seldom performed with the same degree of smoothness as is achieved when pulling the blade through the sharpener. Apart from the discomfort to the user, the difficulties associated with pushing the blade inwards tend to cause the blade cutting edge to be sharpened irregularly such that minute corrugations develop.

SUMMARY OF THE INVENTION

It is an object of the present invention to provide a blade sharpener which has a sharpening action in one direction only, or in which there is a predominant sharpening action in that direction and a less effective sharpening action in the other direction. In a preferred arrangement, the sharpening action, or the predominant sharpening action, is achieved by pulling a blade through the sharpener.

A sharpener in accordance with the invention is characterised in that means is provided for defeating, or partially defeating, the sharpening influence of the sharpening mechanism during movement of a blade through that mechanism in one direction. That defeat, or partial defeat, is accomplished by means which is operative to engage a blade which is located in the sharpener and apply force to that blade which acts counter to the force urging the blade into engagement with the sharpening mechanism. The defeating means in effect tends to lift the blade from engagement with the sharpening mechanism, but in practice there need not be actual separation of the blade and the sharpening mechanism. It is generally sufficient that the influence of the defeating means on the blade is such that there is a force acting on the blade which is counter to the force urging the blade into sharpening engagement with the sharpening mechanism. The ability of the mechanism to effectively sharpen the blade is thereby diminished, and the resistance to travel of the blade through the mechanism is reduced accordingly.

The defeating means is arranged to be responsive to movement of a blade through the sharpener. That is, the defeating means is rendered operative as a consequence of movement of a blade through the sharpener in one direction, and is rendered inoperative in response to such blade movement in the opposite direction.

The defeating means may have any of a variety of forms and may be associated with any of a variety of sharpening mechanisms. In one arrangement, the sharpening mechanism includes a pivoted support on which is mounted the sharpening elements, such as two overlapping cutter plates which define a V-shaped sharpening recess between their respective operative edges. The defeating means includes a blade engaging member, such as a roller, positioned at a front side of the mechanism and mounted on the pivoted support for movement with that support as it swings between forward and rearward extremes of its pivotal movement.

When the support is at its rearward pivotal position, the roller is elevated so as to engage the cutting edge of a blade and thereby prevent that edge contacting, or making firm contact with, the operative edges of the cutter plates. At the rearward pivotal position of the support, however, the roller has a lower disposition which is such as not to impede proper sharpening contact between the blade and the cutter plates.

Obviously abrasive sharpening elements could be used instead of cutters. Also, the blade engaging part of the lifting means need not be a roller, but could, for example, be formed by a pair of upstanding and overlapping pins between which is formed a V-shaped blade receiving space. In that alternative arrangement, the blade cutting edge is adapted to engage each of the two pins in much the same manner as it engages the cutter plates during a sharpening operation. The pins, however, do not have a sharpening function in the normal sense, although they may assist maintenance of the cutting edge by rubbing along that edge. Pins of circular cross sectional shape are generally preferred.

DESCRIPTION OF THE DRAWINGS

Embodiments of the invention are described in detail in the following passages of the specificaton which refer to the accompanying drawings. The drawings, however, are merely illustrative of how the invention might be put into effect, so that the specific form and arrangement of the various features as shown is not to be understood as limiting on the invention.

In the drawings.

DETAILED DESCRIPTION OF PREFERRED EMBODIMENTS

The particular embodiment of the invention as hereinafter described by reference to FIGS. 1 to 6 of the attached drawings is designed for use with a blade protective scabbard, but the invention is not limited to such use.

Figure 1:
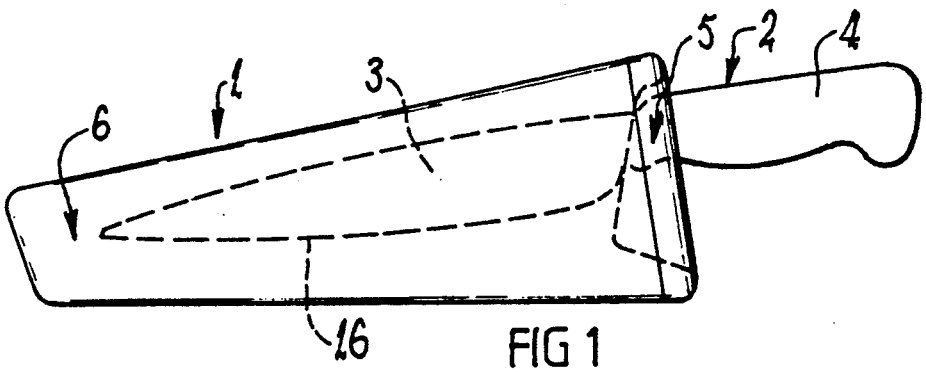
FIG. 1 is a side elevation view of a knife scabbard and sharpener combination incorporating an embodiment of the invention.
Figure 2:
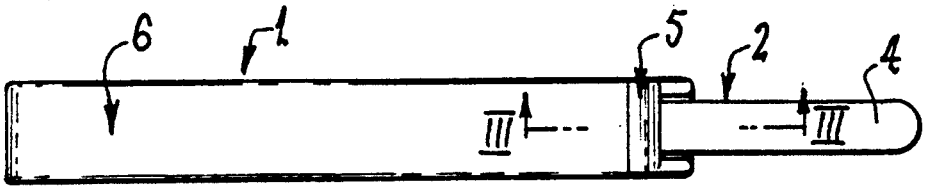
FIG. 2 is a plan view of the combination shown in FIG. 1.

FIGS. 1 and 2 show a typical scabbard 1 for a knife 2, and as best seen in FIG. 1 the blade 3 of the knife 2 is located within the scabbard 1 whereas the knife handle 4 is exposed for engagement by a user. The sharpener of the invention is usable with scabbards different to that shown in the drawings.

Figure 3:
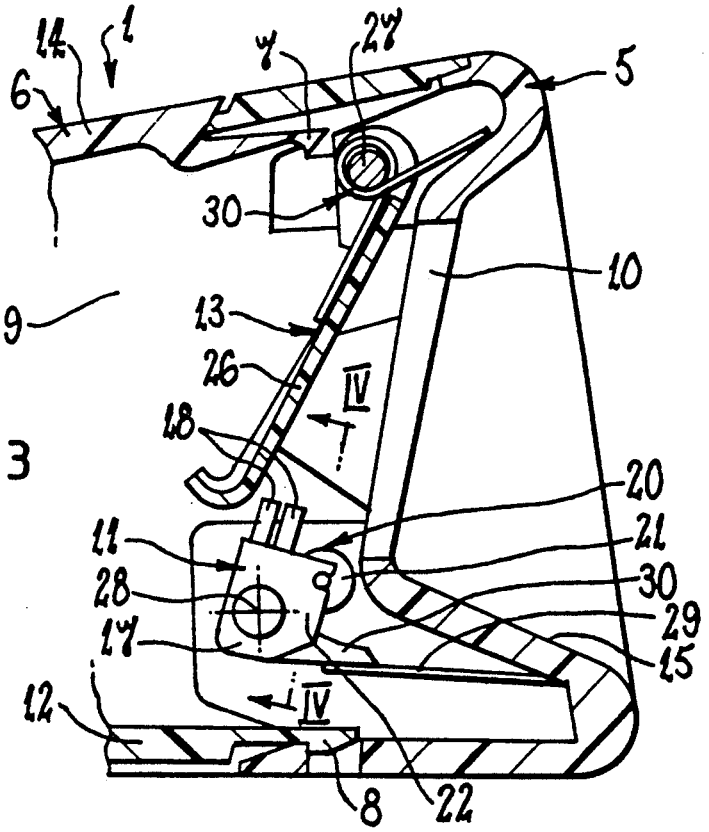
FIG. 3 is an enlarged cross-sectional view taken along line III—III of FIG. 2 but in which the knife has been omitted for convenience of illustration.

In the preferred arrangement shown, as best seen in FIG. 3, a front end portion 5 of the scabbard 1 forms a sharpener module which is releasably attached to a front end of a body portion 6 of the scabbard 1. Any suitable means, such as clips 7 and 8, can be used to releasably connect the module 5 to the body portion 6. The scabbard 1 is hollow to provide a passage 9 for receiving a knife blade 3, and an opening 10 formed in the module 5 provides access to that passage 9 whereby a blade 3 can be inserted into and withdrawn from the scabbard 1.

The sharpener includes a sharpening mechanism 11 which is located within the scabbard 1, preferably adjacent to the access opening 10. In the arrangement shown, the mechanism 11 is attached to the module 5 so as to be removable from the body portion 6 with that module 5. It is preferred that the mechanism is located adjacent a lower wall 12 of the scabbard 1 as shown, and biasing means in the form of a spring influenced latch 13 is mounted within the scabbard 1 adjacent to the scabbard top wall 14 so as to overlie the mechanism 11.

A blade guide ramp 15 is arranged to be engaged by the cutting edge 16 of a blade 3 so as to guide that blade 3 into proper engagement with the mechanism 11, and the opening 10 is preferably relatively narrow so as to also assist in that guiding function.

Figure 5:
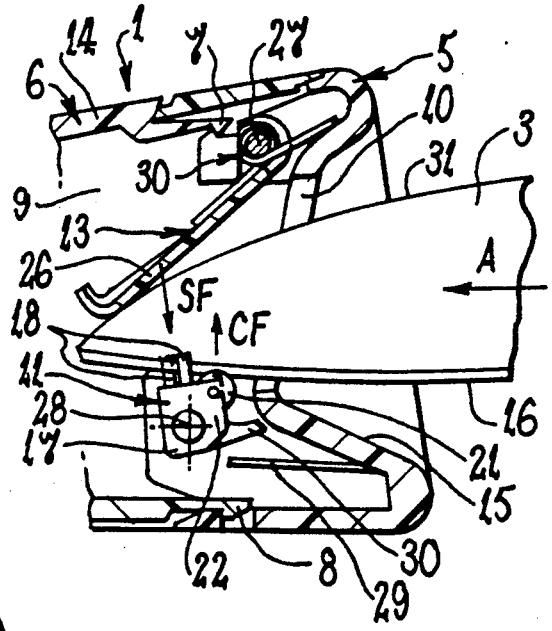
FIG. 5 is a view similar to FIG. 3 but showing a knife blade being inserted into the scabbard.
Figure 6:
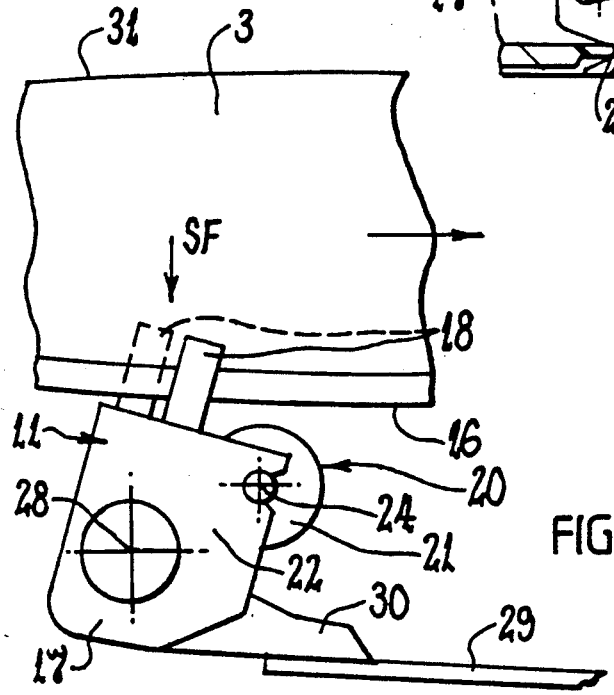
FIG. 6 is a view similar to FIG. 5 but showing a knife blade being withdrawn from the scabbard.

The mechanism 11 includes a support member 17 which is mounted for back and forth swinging movement about a pivot axis 28. In the arrangement shown, stop means 29 is located as to be engaged by a forward extension 30 of the support member 17 and thereby establish the extreme forward position of the mechanism 11 (FIGS. 3 and 6). A similar stop may not be required to establish the rearward position (FIG. 5) for reasons hereinafter explained. It will be appreciated that a stop arrangement quite different to that shown, could be adopted.

Two cutter plates 18 are attached to the support member 17 and are relatively arranged to define a V-shaped sharpening recess 19 (FIG. 4) between them. Such an arrangement is well known and requires no further description. It will be appreciated that sharpening elements other than cutter plates could be adopted in the mechanism 11.

Sharpening defeating means 20 is located at the front side of the support member 17 and is connected to that member so as to move with the member 17 during its rocking movement about the pivot axis 28. In the arrangement shown, the defeating means includes a roller 21 which is located between two laterally spaced arms 22 formed integral with or attached to the member 17. The roller 21 may be composed of any suitable material such as stainless steel, or a plastics material. It may be desirable to arrange the roller 21 for snap engagement with the arms 22 so as to permit convenient removal and replacement. A circumferential groove 23 is preferably provided in the surface of the roller 21, intermediate its ends, to provide a lead or guide within which the cutting edge of a blade 3 (FIGS. 5 and 6) locates when being moved through the mechanism 11.

The roller 21 is rotatable about an axis 24 which is substantially parallel to the pivot axis 28 and is transverse to the longitudinal axis of a blade 3 located in the scabbard passage 9. The roller 21 is spaced forwardly of the plates 18 and is located at an elevated position relative to the pivot axis 28 such as to create a particular relationship between the cylindrical surface of that roller 21 and the base 25 of the recess 19 as hereinafter explained. It is preferred that the plates 18 are located substantially directly above the pivot axis 28 such that there is relatively little rise and fall in the elevation of the recess base 25 during movement of the mechanism about the pivot axis 28.

It is a purpose of the aforementioned particular relationship to create distinct operative and inoperative conditions of the sharpening defeating means. With the arrangement described, that is achieved because of the change in elevation of the roller 21 between the FIG. 5 position (operative condition) and the FIG. 6 position (inoperative condition). In the FIG. 5 position, the roller 21 is able to bear against a blade 3, whereas it is not so able in the FIG. 6 position. On the other hand, there is relatively little change in the elevation of the recess base 25 between the FIG. 5 and FIG. 6 positions.

In the arrangement shown, the latch 13 includes a lever 26 which is mounted for swinging movement about a pivotal axis 27 and is urged into a forwardmost position (FIG. 3) by a spring 30 or other suitable means. In use, the lever 26 is urged to swing rearwards away from the entrance opening 10 in response to engagement by a blade 3 being moved into the scabbard 1, as shown in FIG. 5. The lever 26 maintains engagement with the back edge 31 of the blade 3 due to the influence of the spring 30 and thereby maintains appropriate sharpening pressure between the sharpening mechanism 11 and the longitudinal edge portion of the blade 3 which forms the cutting edge 16.

Operation of the foregoing arrangement is as follows.

When a blade 3 is being moved (pushed) into and through the mechanism 11 as shown in FIG. 5, initial engagement between the blade 3 and the mechanism 11 causes the mechanism 11 to swing rearwards about the axis 28 so that the mechanism 11 adopts the position shown in FIG. 5. At that position, the roller 21 has a relatively elevated position and bears against the cutting edge 16 of the blade 3 and tends to push that blade 3 out of the cutter plate recess 19. That tendency will increase with increased force between the blade 3 and the plates 18 so that there is a positive hindrance to the blade 3 being pressed into full contact (the sharpening mode) with the plates 18. That is, the roller 21 imposes a force CF on the blade 3 which acts counter to the force SF which causes the blade 3 to engage the sharpener plates 18. In the result, the pressure generated between the blade 3 and the plates 18 is insufficient to cause sharpening, or at least sharpening of a significant nature.

As the blade 3 is pulled back through the mechanism 11 as shown in FIG. 6, the mechanism 11 swings forward as shown. That causes the roller 21 to move to a lower elevation at which it is below the blade cutting edge 16. As a consequence, the defeating means 20 is rendered inoperative and the blade 3 is subjected to the full sharpening influence of the mechanism 11 during its outward movement through that mechanism.

It will be apparent from the foregoing that the arrangement described effectively meets the problems associated with two way sharpening. The defeating means reduces resistance to inward (pushing) movement of the knife blade and thereby removes the discomfort otherwise experienced by the user. On the other hand, sharpening during outward (pulling) movement is not impaired and can be performed to the full extent as before.

In the preferred arrangement shown, the roller 21 of the defeating means 20 is provided with a groove 23 which serves as a locating means for the cutting edge 16 of a knife blade 3 and which is arranged so that the cutting edge 16 cannot bottom in that groove 23. That is, the locating groove 23 is arranged relative to the blade 3 so that the blade 3 cannot be inserted into the groove 23 to such a depth that the actual cutting edge 16 of the blade 3 engages the base of the groove 23. Such an arrangement has the advantage of minimizing possible dulling of the cutting edge 16 as a consequence of movement of that edge over the roller 21.

Figure 4:
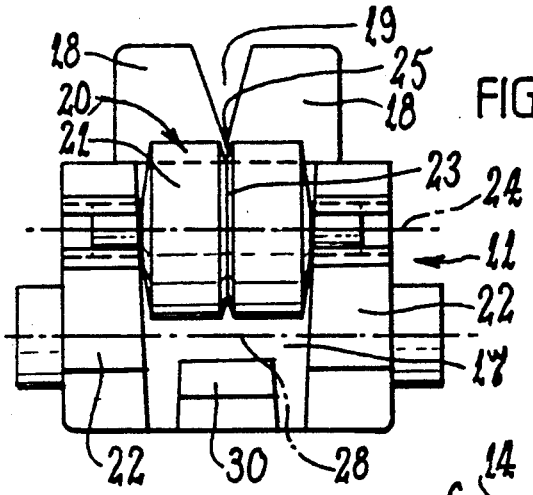
FIG. 4 is a view taken along line IV—IV of FIG. 3 but in which various parts have been omitted for convenience of illustration.

The attached FIG. 4 shows, in front elevation, a sharpening mechanism of the kind shown in FIGS. 1 to 3 and having a circumferential groove 1 formed in the roller 2. The foregoing anti-bottoming aspect of the invention is not limited to use with the particular mechanism shown, but it will be convenient to describe that aspect with particular reference to that mechanism.

Figure 7:
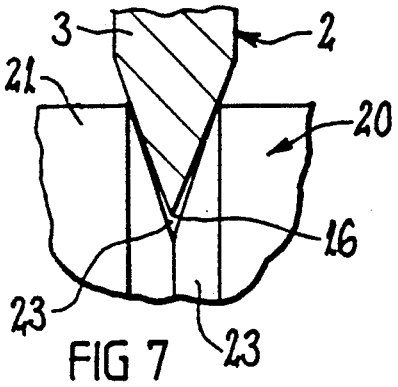
FIG. 7 is a cross-sectional view showing the manner of engagement between the knife blade and roller as shown in FIG. 5.

It is preferred to achieve the anti-bottoming characteristic by selection of an appropriate relationship between the cross-sectional shape of the groove 23 and the cross-sectional shape of the longitudinal edge portion of the blade 3 which forms the cutting edge 16. One such arrangement is shown in FIG. 7. In that arrangement, the blade 3 is prevented from engaging the base of the groove 23 because of the difference in the included angles of the groove 23 and the blade edge portion respectively. In particular, the included angle of the groove 23 is less than the included angle of the blade edge portion which forms the edge 16.

Figure 8:
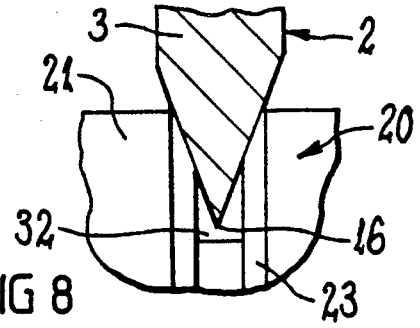
FIG. 8 is a view similar to FIG. 7 but showing another embodiment of the invention.

FIG. 8 shows a variation of the last described arrangement in which there need not be a difference between the two included angles. In that particular variation, a channel 32 is formed in the base of the groove 23 to create a clearance space for the blade edge 6. Other techniques could be adopted to achieve the same result.

The groove 23 can be of any shape suitable to achieve the anti-bottoming requirement. The groove shapes shown by FIGS. 7 and 8 are therefore examples only.

In a further variation of the arrangement particularly described, a biasing force is applied to the sharpening mechanism 11 to ensure that it adopts the operative position for the defeating means 20 at the end of a blade sharpening operation. Assuming the sharpening mechanism 11 is used with a blade protecting scabbard 1 as previously described, it will generally be the case that the mechanism 11 is arranged to sharpen the blade during withdrawal from the scabbard. The defeating means 20 therefore needs to be operative during insertion of a blade so as to defeat, or substantially defeat, the sharpening influence of the sharpening mechanism 11 at that time.

It may happen that the mechanism 11 will stick in the forward position after a sharpening operation, in which event the defeating means is held inoperative. The mechanism 11 may be urged to move to the rearward (defeating means operative) position by the influence of an inwardly moving and engaging knife blade 3, but if that rearward movement of the mechanism 11 is delayed by insufficiently free pivotal movement of the mechanism, the user will encounter unexpected and perhaps uncomfortable resistance to initial movement of the blade into the scabbard.

Figure 9:
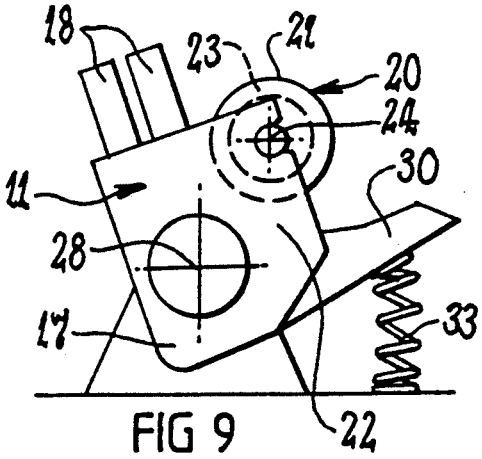
FIG. 9 shows a modification of the sharpening mechanism shown in FIGS. 1 to 6.

The foregoing problem may be substantially eliminated by use of biasing means as referred to above. FIG. 9 shows one particular arrangement incorporating such biasing means in the form of a compression spring 33 acting between the mechanism 11 and part of the scabbard 1. Other types of biasing means could be used. The force imposed by the spring 33 need not be high. Indeed, it is normally preferred that the spring 33 imposes a light force so as not to hinder the sharpening operation during withdrawal of the blade 3 from the scabbard 1. The primary purpose of the spring 33 is to ensure that the sharpening mechanism 11 is at the rearward tilted position at the time of initial engagement by an inwardly moving knife blade 3.

Figure 10:
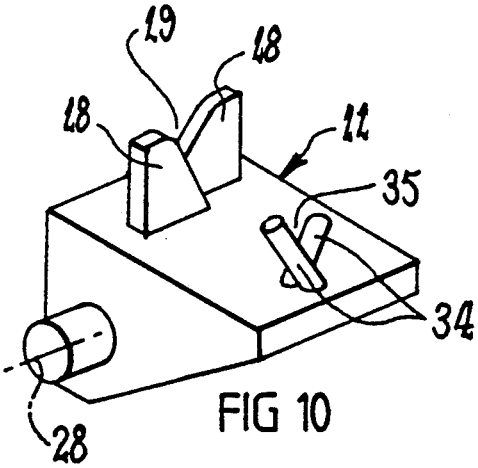
FIG. 10 shows yet another embodiment of the invention.

According to another variation of the particularly described arrangement, rubbing means is substituted for the roller 21. In one form of that variation as shown in FIG. 10, the rubbing means comprises a pair of upstanding pins 34 which slope and overlap as shown to define between them a V-shaped blade receiving space 35. The blade 3 engages within that space 35 as it does within the sharpening recess 19 of the mechanism 11, but the pins 34 simply rub against rather than sharpen (in the normal sense) the blade cutting edge 16. In a preferred form, as shown, the pins 34 are of circular cross-sectional shape.

In yet another variation of the arrangement described, the defeating means is located separate from the sharpening mechanism and is positioned forward of that mechanism. Such an arrangement might be adopted where the sharpening mechanism does not pivot as described in relation to FIGS. 1 to 6, in which event the defeating means may be arranged to swing up and down in the manner previously described, in response to relative movement of an engaging blade 3.

Figure 11:
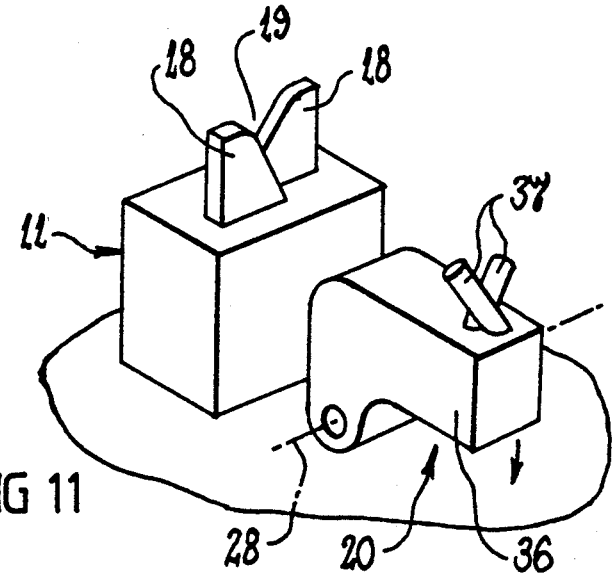
FIG. 11 shows still another embodiment of the invention.

FIG. 11 shows in diagrammatic form an arrangement of the kind last described. In that arrangement, the sharpening mechanism 11 is attached to a support so as to be held against relative movement. The defeating means 20 includes a member 36 mounted for rocking movement about the pivot axis 28, and has a pair of overlapping rubbing pins 37 which function in the same manner as the pins 34 of the FIG. 10 arrangement.

The operation of the FIG. 11 arrangement is essentially the same as that of the FIGS. 1 to 6 arrangement. The only difference is that, in the former case, the sharpening mechanism 11 does not pivot as it does in the latter case.

It will be appreciated from the foregoing that the present invention provides substantial advantages in the art of sharpening blades. In particular, the ability to control sharpening, or at least fully effective sharpening, to one direction of movement of a blade is of substantial advantage.

Various alterations, modifications and/or additions may be introduced into the constructions and arrangements of parts previously described without departing from the spirit or ambit of the invention as defined by the appended claims.

Having now described my invention, what I claim as new and desire to secure by Letters Patent is:

1. A blade sharpener including, a sharpening mechanism which is operable to sharpen the cutting edge of a blade engaging that mechanism and being moved longitudinally relative thereto, sharpening defeating means connected to a support for movement relative thereto between an operative condition and an inoperative condition, said defeating means being arranged to adopt said operative condition in response to longitudinal movement of said blade through the sharpener in one direction, said defeating means being operative to apply a force against said blade acting counter to a force causing said blade to engage said mechanism when said defeating means is in said operative condition, and said defeating means being arranged to adopt said inoperative condition in response to said longitudinal movement of the blade in a direction opposite to said one direction, said defeating means not being operative to apply said counter force to said blade when said defeating means is in said inoperative condition.

2. A sharpener according to claim 1, wherein the connection between said sharpening defeating means and said support is a pivotal connection.

3. A sharpener according to claim 2, wherein said sharpening mechanism and said sharpening defeating means are connected together for movement together about the axis of said pivotal connection.

4. A sharpener according to claim 3, wherein said mechanism has a front side and a rear side, and said defeating means is located at the front side of said mechanism.

5. A sharpener according to claim 4, wherein said defeating means includes a roller which is located at said front side of the mechanism and is arranged to engage a said blade and apply said counter force thereto, and said roller is rotatable about an axis extending substantially parallel to the axis of said pivotal connection and transverse to the longitudinal axis of a said blade located in said sharpener.

6. A sharpener according to claim 1, wherein said mechanism includes a support member and a pair of sharpening elements attached to said member and arranged to define a sharpening recess between them, said recess being arranged to receive the longitudinal edge portion of a said blade which forms the cutting edge of that blade for the purpose of said mechanism performing a sharpening operation on that blade, and said defeating means includes a blade engaging member which is connected to said support member and is located to one side of said recess so as to be engagable by a said blade located in that recess.

7. A sharpener according to claim 6, wherein said blade engaging member is spaced from said sharpening elements and is located at a front side of said mechanism.

8. A sharpener according to claim 6, wherein said connection between said defeating means and said support is a pivotal connection between said support member and said support, and the axis of said pivotal connection is transverse to the longitudinal axis of a said blade located in said recess.

9. A sharpener according to claim 8, wherein said blade engaging member is a roller adapted for rotation about an axis extending substantially parallel to said pivotal connection axis, said mechanism has a front side and a rear side, and said roller is located forwardly of both said pivotal connection axis and said sharpening elements such that movement of said mechanism about said pivotal connection axis causes said roller to be raised or lowered relative to the base of said sharpening recess according to whether the said sharpening mechanism is pivoted rearwardly or forwardly respectively.

10. A sharpener according to claim 9, wherein a pair of arms are attached to said support member and extend forwardly of that member in laterally spaced relationship, and said roller is connected to said support member by attachment to said arms.

11. A sharpener according to claim 9, wherein stop means is provided to limit the extent of forward pivotal movement of said mechanism.

12. A sharpener according to claim 6, wherein said blade engaging member is a roller adapted for rotation about an axis extending transverse to the longitudinal axis of a said blade located in said recess.

13. A sharpener according to claim 12, wherein said roller has a circumferential groove positioned between its ends and which is adapted to receive said blade longitudinal edge portion, said groove is substantially aligned with said recess so that said longitudinal edge portion of a blade to be sharpened by said mechanism can be located both in said groove and in said recess.

14. A sharpener according to claim 13, wherein said groove has a cross-sectional shape which is related to the cross-sectional shape of said blade longitudinal edge portion so that the blade cutting edge cannot engage the base of said groove.

15. A sharpener according to claim 1, wherein said support forms part of a blade protective scabbard which has a front end and a rear end, said scabbard has a passage for containing a said blade, and a blade access opening is provided at said front end to enable a said blade to be moved into and withdrawn from said passage.

16. A sharpener according to claim 15, wherein said mechanism is located within said scabbard adjacent said access opening and said support forms part of a lower wall of said scabbard.

17. A sharpener according to claim 16, wherein biasing means is provided within the scabbard and is arranged to engage and press against the back edge of a blade located in said passage so as to urge the cutting edge of that blade into engagement with said mechanism.

18. A sharpener according to claim 16, wherein a front end portion of said scabbard is in the form of a module which is removably attached to a main body portion of said scabbard, and said sharpener mechanism is mounted within said module.

* * * * *